US009954317B2

(12) United States Patent
Zhao et al.

(10) Patent No.: US 9,954,317 B2
(45) Date of Patent: Apr. 24, 2018

(54) ELECTRICAL CONNECTOR HAVING AN INSULATIVE OUTER COVER AND A BRACKET INSERT MOLDED WITH THE OUTER COVER

(71) Applicant: FOXCONN INTERCONNECT TECHNOLOGY LIMITED, Grand Cayman (KY)

(72) Inventors: Jun Zhao, Huaian (CN); Tao Yao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/636,564

(22) Filed: Jun. 28, 2017

(65) Prior Publication Data

US 2017/0373441 A1 Dec. 28, 2017

(30) Foreign Application Priority Data

Jun. 28, 2016 (CN) ..... 2016 1 0482960

(51) Int. Cl.

| | |
|---|---|
| ***H01R 13/6581*** | (2011.01) |
| ***H01R 24/60*** | (2011.01) |
| ***H01R 12/58*** | (2011.01) |
| ***H01R 13/6591*** | (2011.01) |
| ***H01R 13/516*** | (2006.01) |
| *H01R 107/00* | (2006.01) |

(52) U.S. Cl.

CPC ..... *H01R 13/6581* (2013.01); *H01R 12/58* (2013.01); *H01R 13/516* (2013.01); *H01R 13/6591* (2013.01); *H01R 24/60* (2013.01); *H01R 2107/00* (2013.01)

(58) Field of Classification Search

CPC ..... H01R 13/6581; H01R 13/504; H01R 13/6591; H01R 13/6587; H01R 13/6597; H01R 13/6585; H01R 13/516; H01R 12/58; H01R 12/724; H01R 12/60; H01R 12/75; H01R 24/60; H01R 24/62; H01R 2107/00

USPC ..... 439/607.58

See application file for complete search history.

(56) References Cited

U.S. PATENT DOCUMENTS

| | | | | |
|---|---|---|---|---|
| 9,496,664 | B2 * | 11/2016 | Little | H01R 13/6587 |
| 9,525,241 | B1 | 12/2016 | Su | |
| 9,647,369 | B2 * | 5/2017 | Tsai | H01R 4/02 |
| 9,742,123 | B2 * | 8/2017 | Yokoyama | H01R 13/6591 |

(Continued)

FOREIGN PATENT DOCUMENTS

| | | |
|---|---|---|
| CN | 204167590 U | 2/2015 |
| CN | 204966754 U | 1/2016 |

(Continued)

*Primary Examiner* — Jean F Duverne

(74) *Attorney, Agent, or Firm* — Wei Te Chung; Ming Chieh Chang

(57) ABSTRACT

An electrical connector includes: a contact module including an insulative housing and an upper and lower rows of contacts, the insulative housing having a base and a tongue; a shielding shell enclosing the contact module and having a pair of soldering legs; an insulative outer cover enclosing the shielding shell; and a pair of brackets insert-molded with the outer cover; wherein each of the pair of brackets is locked to the insulative housing to prevent a corresponding soldering leg from moving outwardly.

13 Claims, 17 Drawing Sheets

(56) References Cited

U.S. PATENT DOCUMENTS

| | | | | |
|---|---|---|---|---|
| 2015/0229077 | A1* | 8/2015 | Little | H01R 12/724 439/78 |
| 2015/0244111 | A1* | 8/2015 | Ju | H01R 13/6585 439/607.05 |
| 2016/0141806 | A1* | 5/2016 | Guo | H01R 13/504 439/607.01 |
| 2016/0315424 | A1* | 10/2016 | Tsai | H01R 13/6581 |
| 2016/0329646 | A1* | 11/2016 | Tsai | H01R 12/75 |
| 2016/0380388 | A1* | 12/2016 | Guo | H01R 24/60 439/83 |
| 2017/0018883 | A1 | 1/2017 | Chen | |
| 2017/0033507 | A1* | 2/2017 | Tsai | H01R 24/62 |
| 2017/0040721 | A1* | 2/2017 | Tsai | H01R 13/502 |
| 2017/0040747 | A1* | 2/2017 | Hayashi | H01R 13/6585 |
| 2017/0040750 | A1* | 2/2017 | Little | H01R 13/6597 |

FOREIGN PATENT DOCUMENTS

| | | | |
|---|---|---|---|
| CN | 204966762 | U | 1/2016 |
| CN | 105449443 | A | 3/2016 |

* cited by examiner

ELECTRICAL CONNECTOR HAVING AN INSULATIVE OUTER COVER AND A BRACKET INSERT MOLDED WITH THE OUTER COVER

BACKGROUND OF THE INVENTION

1. Field of the Invention

The present invention relates to an electrical connector having an insulative outer cover insert-molded with a pair of metallic brackets to obtain a secured structure between the outer cover and an insulative housing and a shielding shell thereof. This application relates to a copending application having the same applicant, the same inventors and the same filing date with a title of "ELECTRICAL CONNECTOR HAVING A SHIELDING SHELL WITH A PAIR OF SIDE ARM SOLDERING LEGS FIRMLY HELD BY AN INSULATIVE HOUSING".

2. Description of Related Arts

China Patent No. 105449443, issued on Mar. 30, 2016, discloses a waterproof electrical connector including an insulative housing, plural contacts retained to the housing, a shielding shell enclosing the housing, and an insulative outer cover enclosing the shielding shell.

U.S. Patent Application Publication No. 2017/0018883, published on Jan. 19, 2017, discloses, among others, an insulated housing, an inner shell enclosing and secured to the housing, and an outer shell enclosing and secured to the inner shell.

SUMMARY OF THE INVENTION

An electrical connector comprises: a contact module including an insulative housing and an upper and lower rows of contacts, the insulative housing having a base and a tongue; a shielding shell enclosing the contact module and having a pair of soldering legs; an insulative outer cover enclosing the shielding shell; and a pair of brackets insert-molded with the outer cover; wherein each of the pair of brackets is locked to the insulative housing to prevent a corresponding soldering leg from moving outwardly.

DETAILED DESCRIPTION OF THE PREFERRED EMBODIMENT

Figure 1:
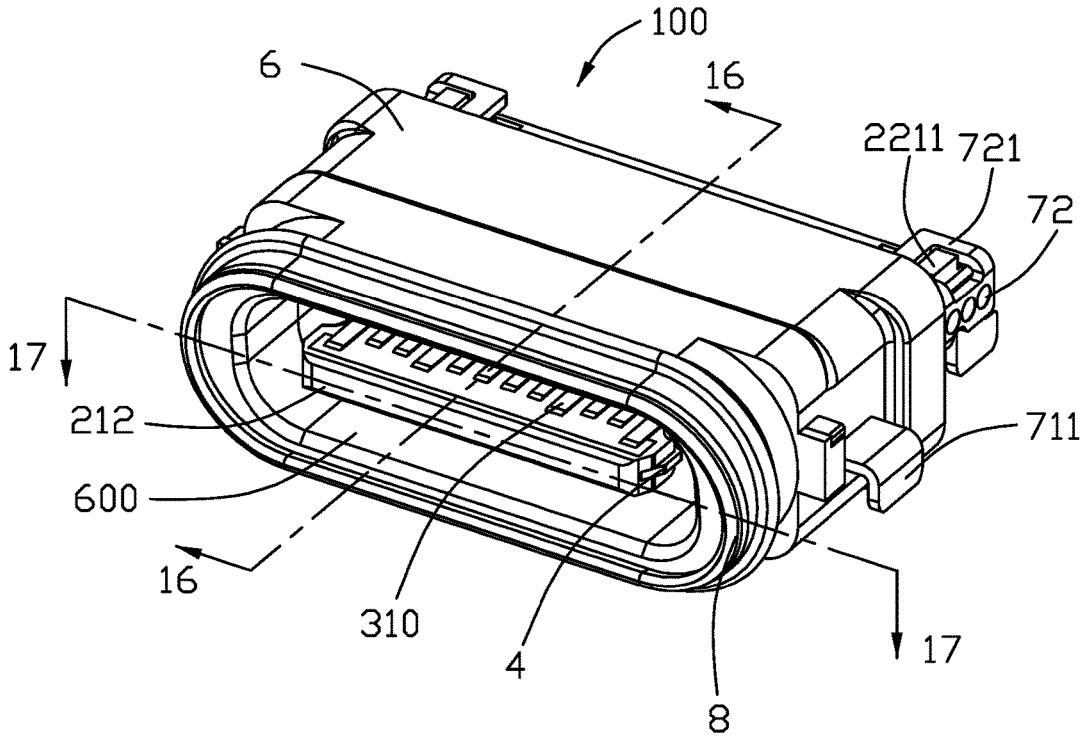
FIG. 1 is a perspective view of an electrical connector in accordance with the present invention.
Figure 2:
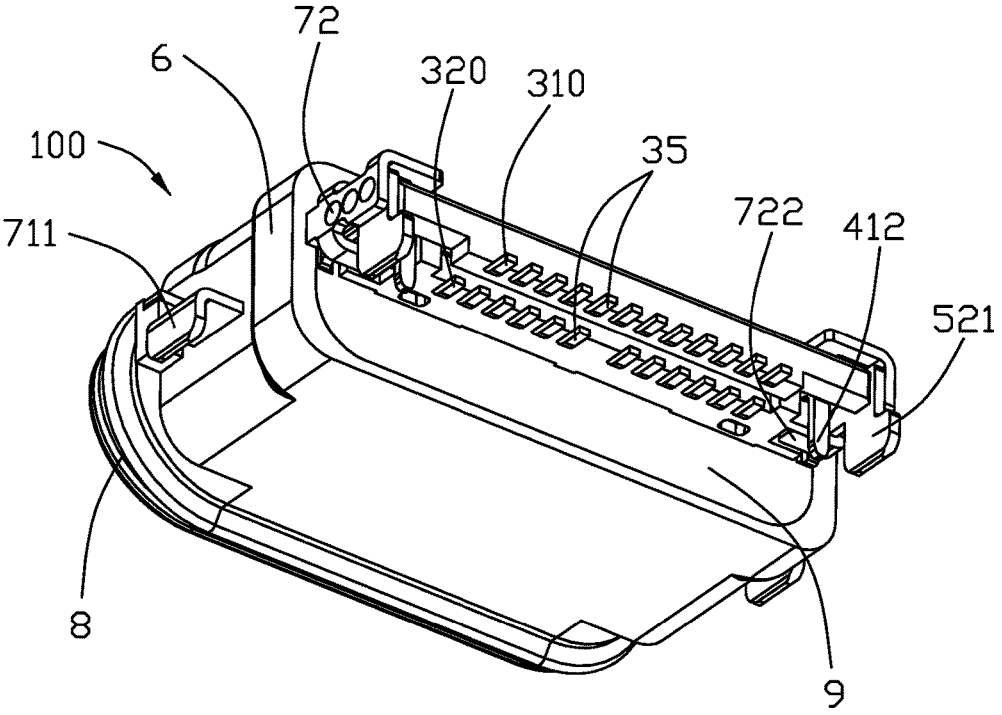
FIG. 2 is a further perspective view of the electrical connector.
Figure 3:
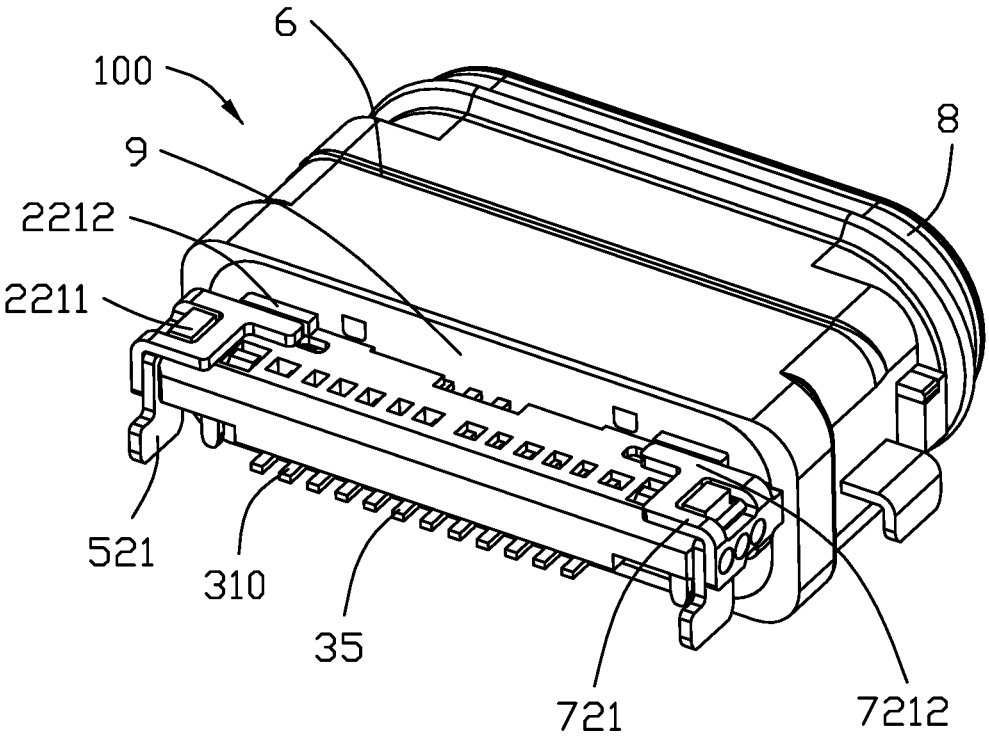
FIG. 3 is another perspective view of the electrical connector.
Figure 4:
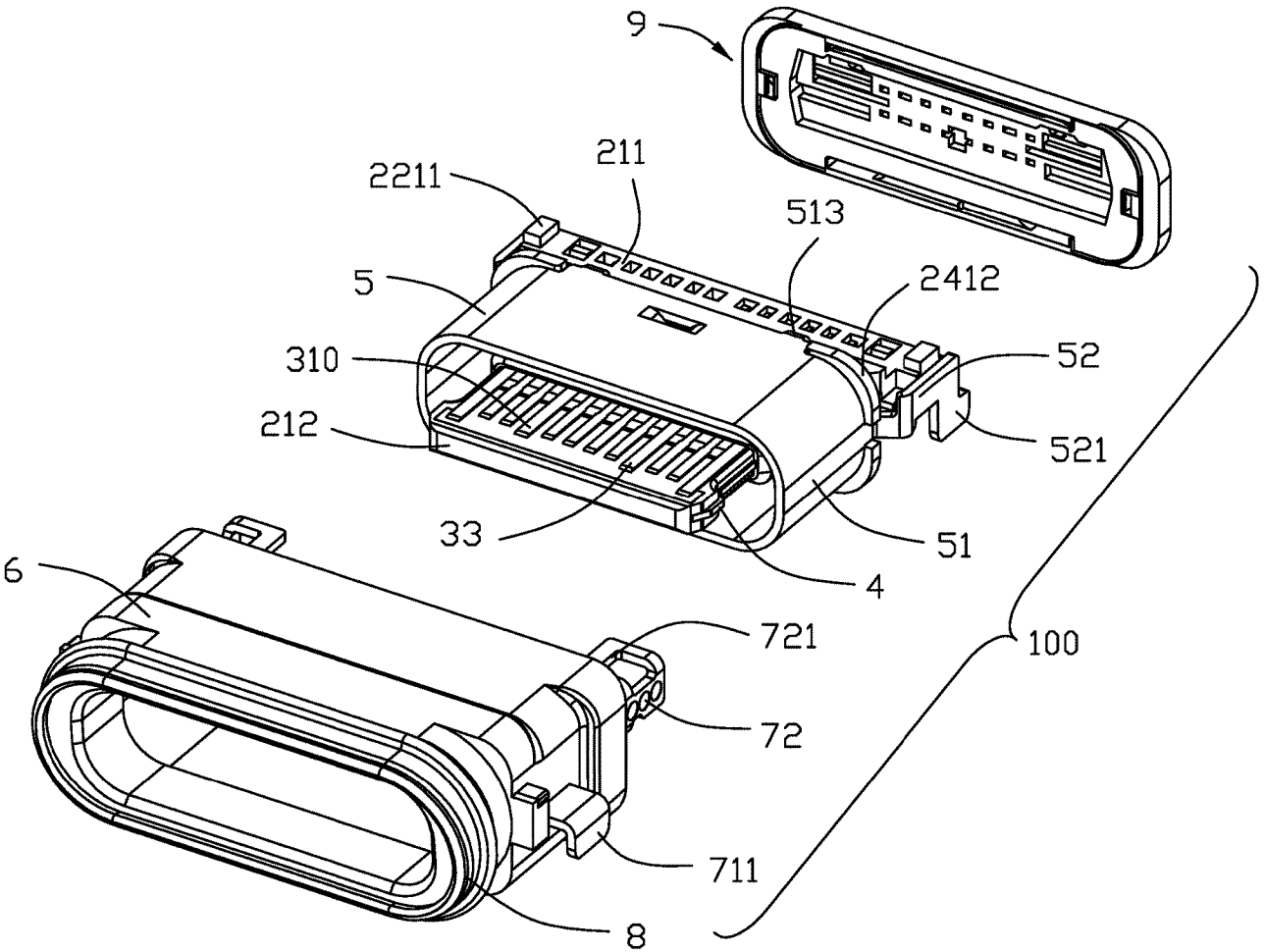
FIG. 4 is an exploded view of the electrical connector.
Figure 5:
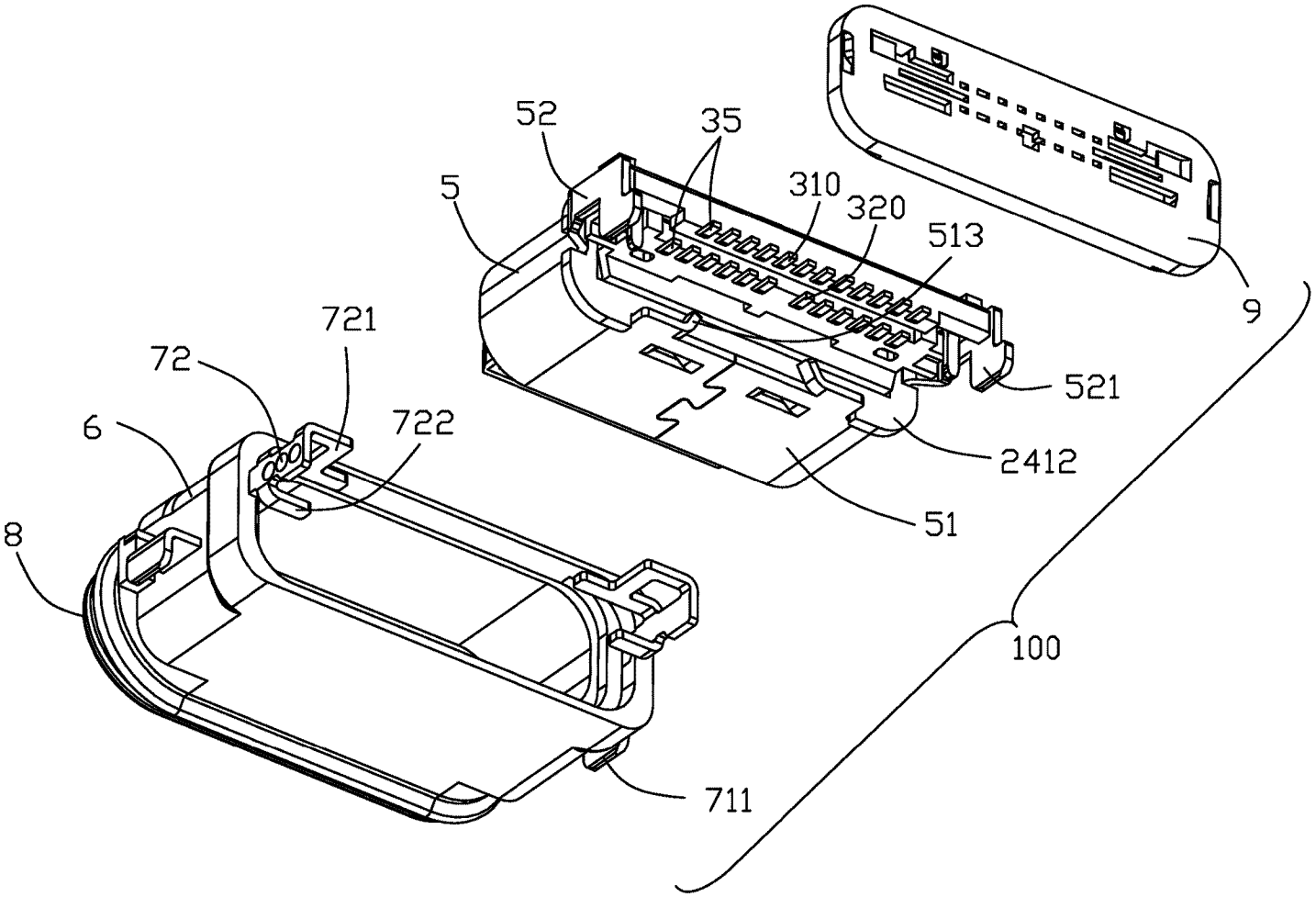
FIG. 5 is another exploded view of the electrical connector.
Figure 6:
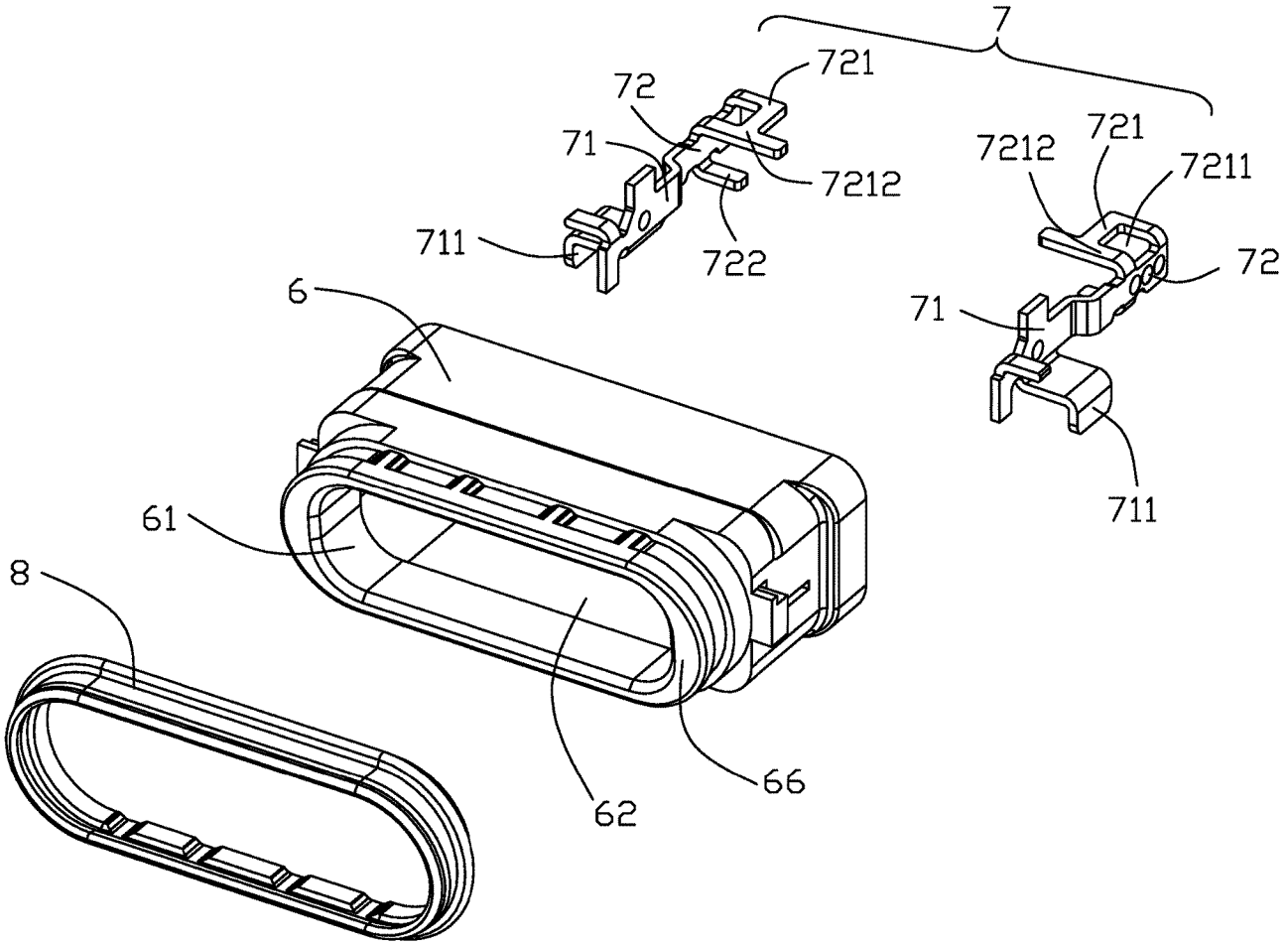
FIG. 6 is a perspective view of an insulative outer cover, a pair of brackets, and a sealing member of the electrical connector.
Figure 7:
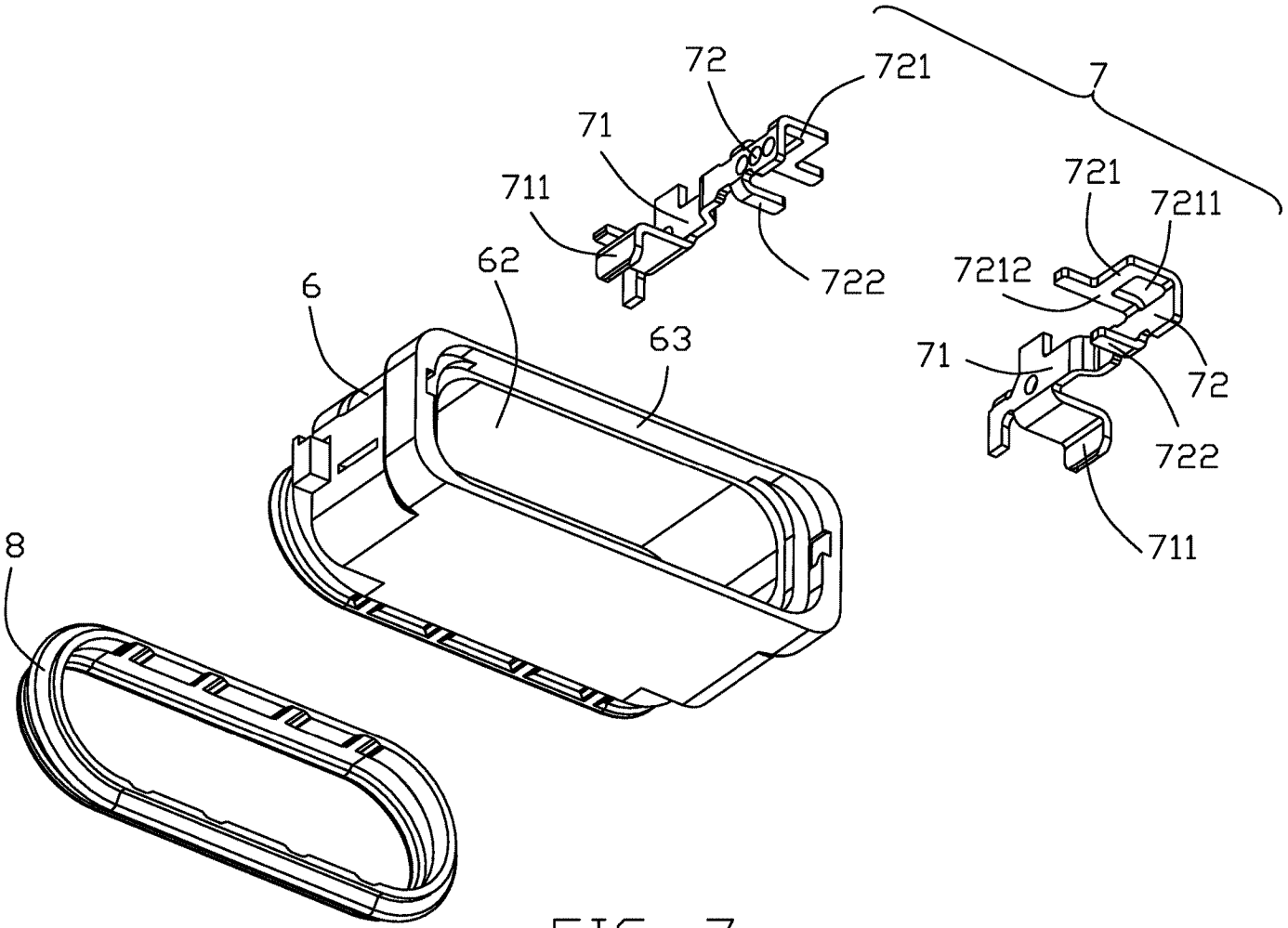
FIG. 7 is a view similar to FIG. 6 but from a different perspective.
Figure 8:
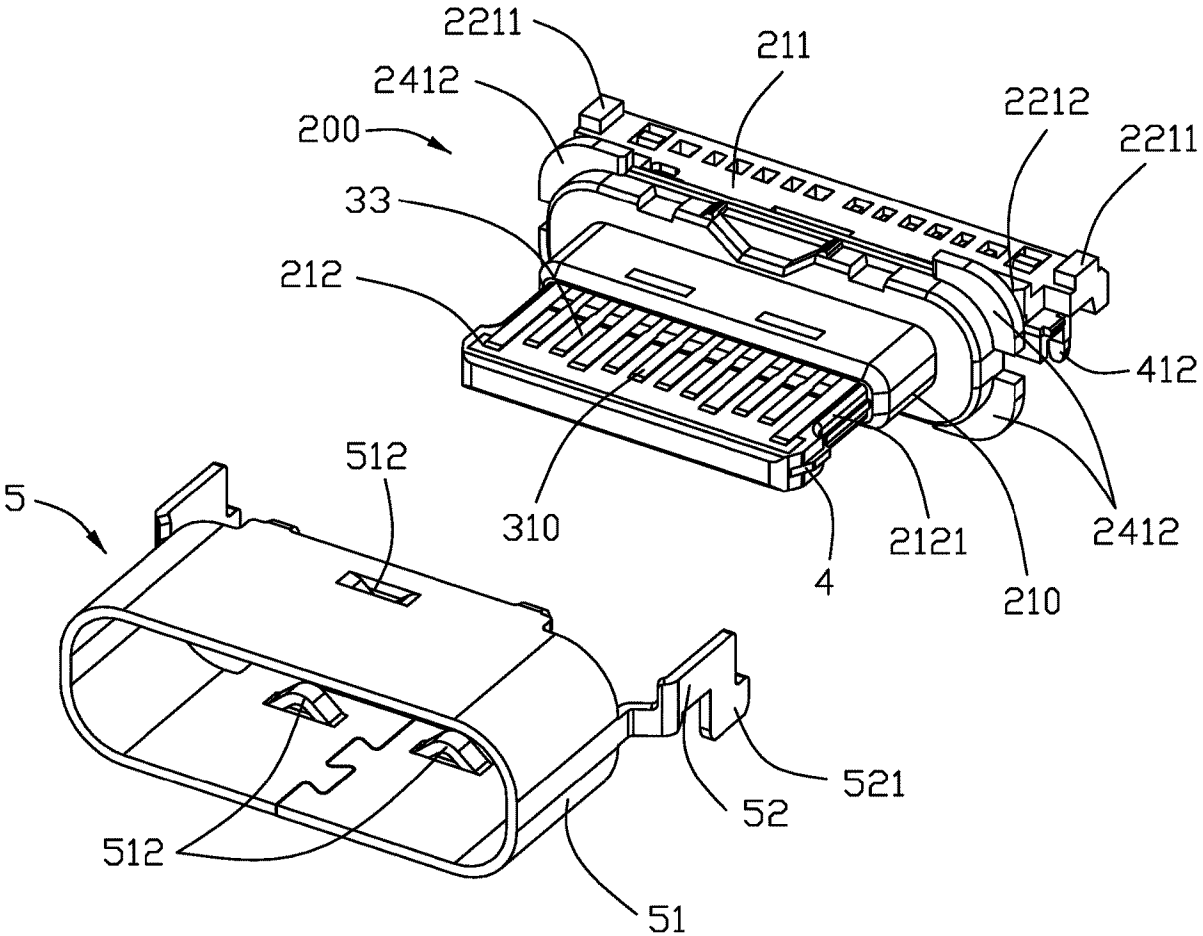
FIG. 8 is a perspective view of a contact module and a shielding shell of the electrical connector.
Figure 9:
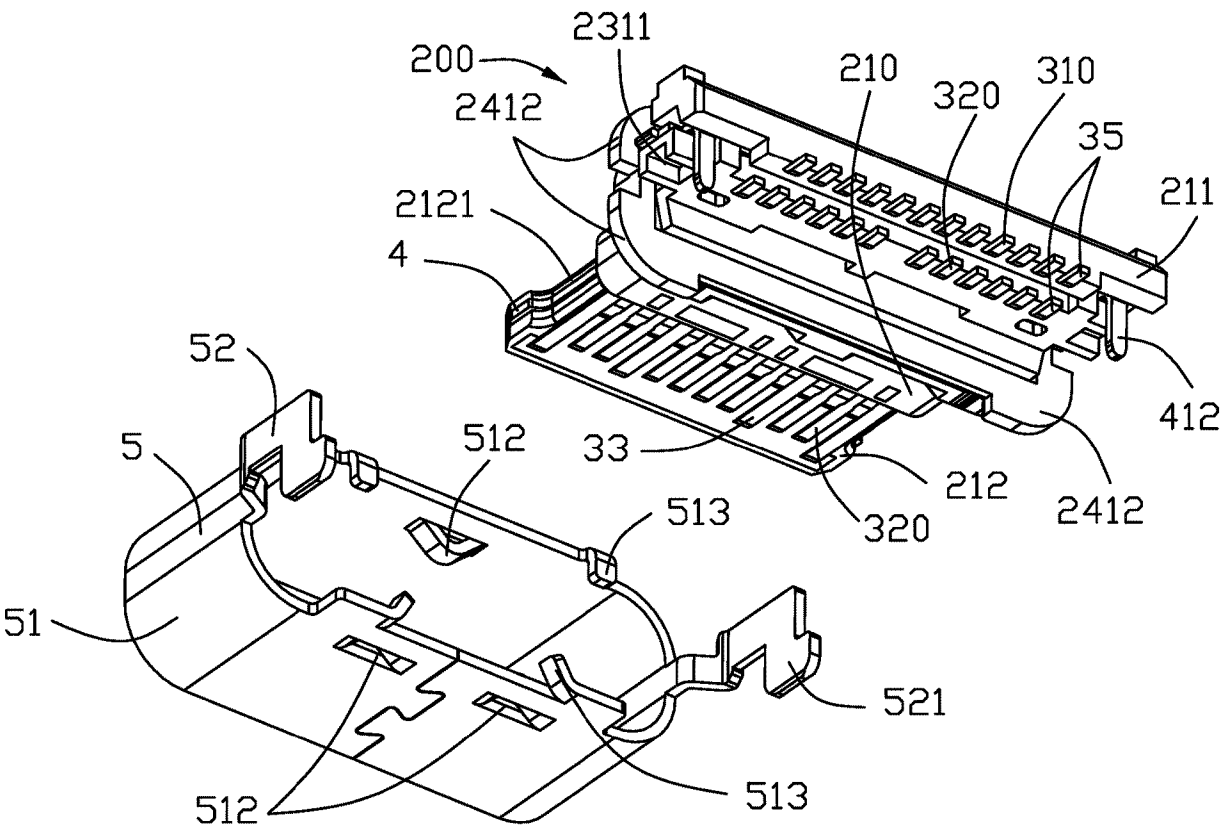
FIG. 9 is a view similar to FIG. 8 but from a different perspective.
Figure 10:
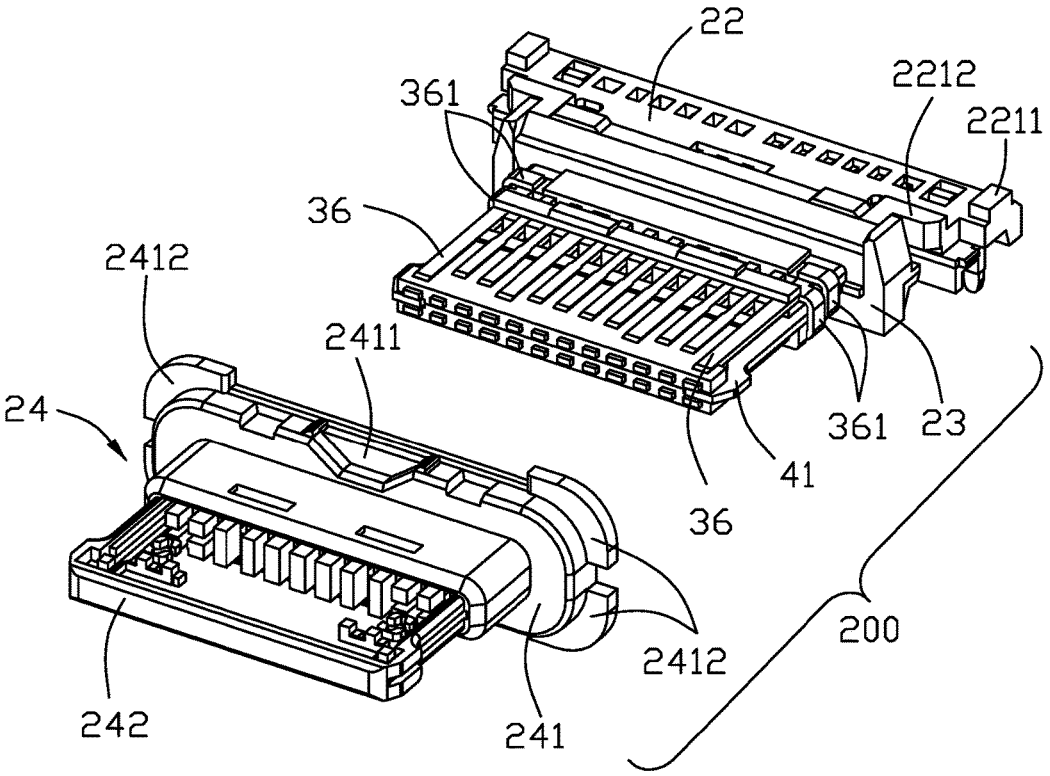
FIG. 10 is an exploded view of the contact module in FIG. 8.
Figure 11:
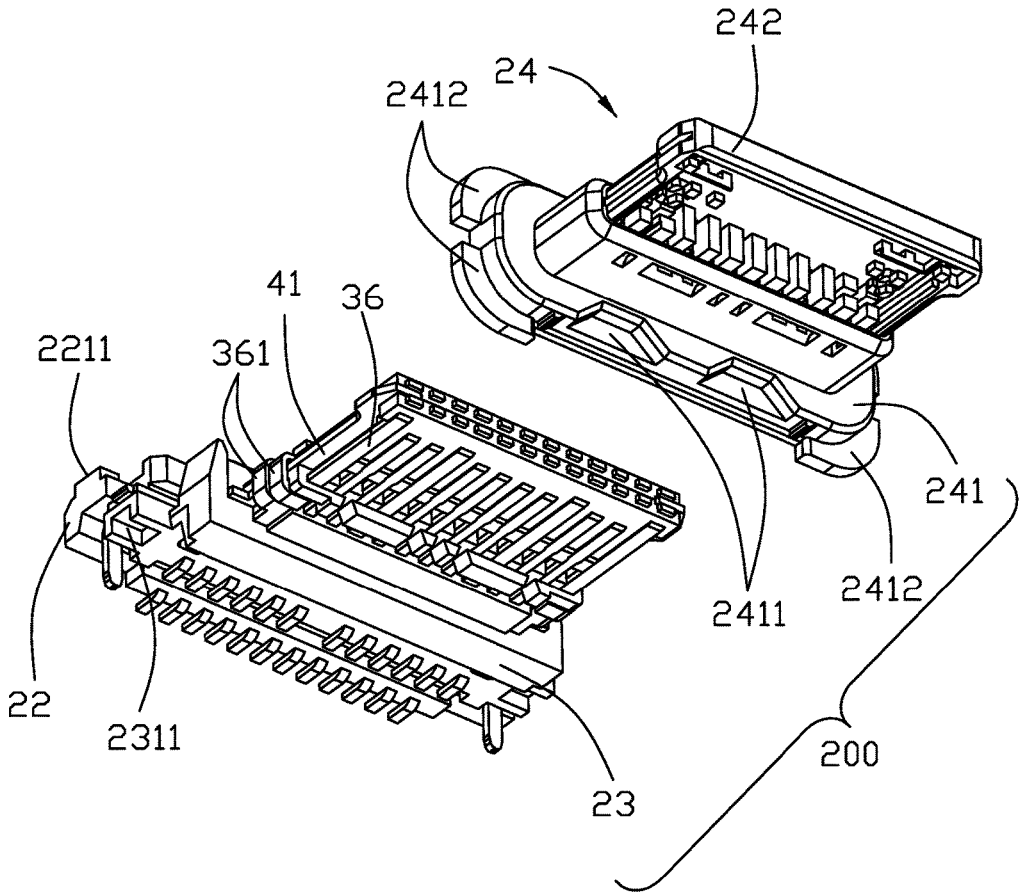
FIG. 11 is a view similar to FIG. 10 but from a different perspective.
Figure 12:
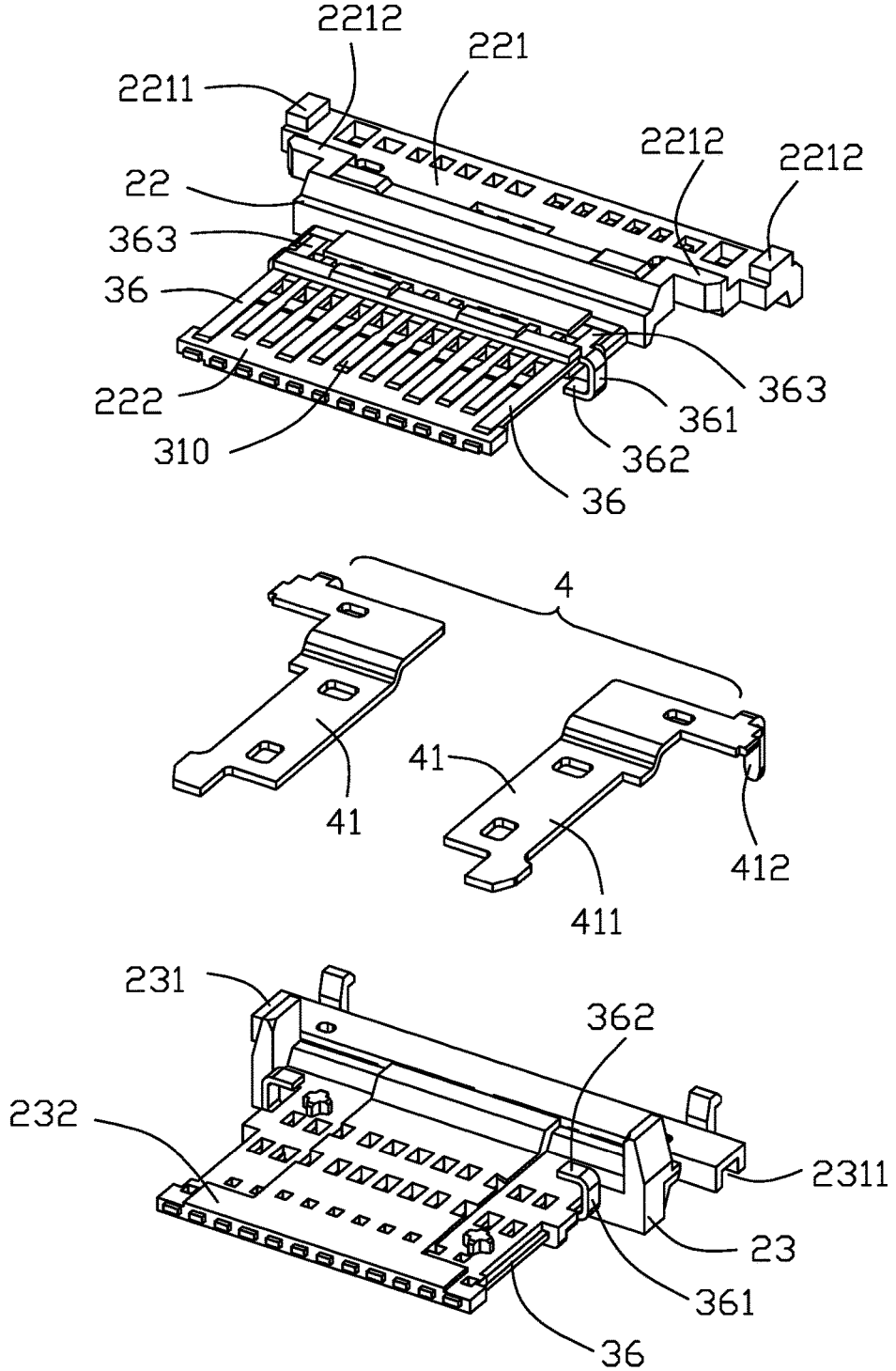
FIG. 12 gives a further exploded view of FIG. 10 omitting a molding body thereof.
Figure 13:
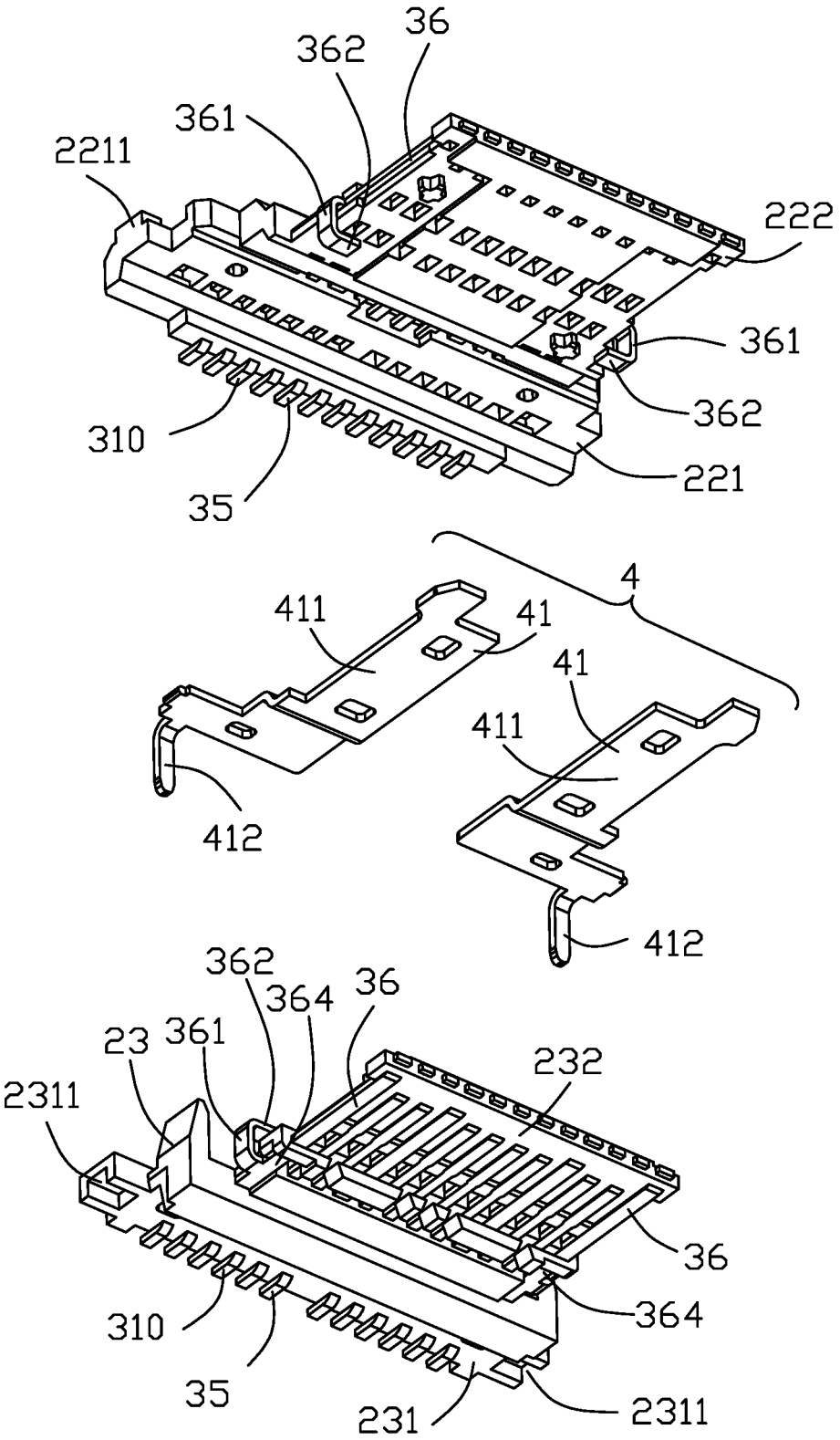
FIG. 13 is a view similar to FIG. 12 but from a different perspective.

Referring to FIGS. 1 to 17, an electrical connector 100 to be mounted on a printed circuit board comprises a contact module 200, a shielding shell 5 enclosing the contact module 200, an insulative outer cover 6 enclosing the shielding shell 5, and a pair of brackets 7 insert-molded with the outer cover 6. The electrical connector 100 may further include a front sealing member 8 and a rear sealing member 9 for reinforced water proofing purpose.

The contact module 200 includes an insulative housing 210 and an upper and lower rows of contacts 310 and 320. A metal sheet 4 may be further provided in the housing between the upper and lower rows of contacts for grounding/shielding/latching.

Referring specifically to FIGS. 8 to 13, the insulative housing 210 has a base 211 and a front tongue 212. The tongue 212 has a pair of side notches 2121. The insulative housing 210 includes an upper contact unit 22, a lower contact unit 23, and a molding body 24. The upper contact unit 22 includes a first base part 221 and a first tongue part 222. The lower contact unit 23 includes a second base part 231 and a first tongue part 232. The molding body 24 includes a third base part 241 and a third tongue part 242. The first, second, and third base parts 221, 231, and 241 constitute the base 211 and the first, second, and third tongue parts 222, 232, and 242 constitute the tongue 212.

The first base part 221 has a pair of protrusions 2211 extending upwardly from an upper surface thereof and a pair of stops 2212 in front of the protrusions 2211. The second base part 231 has a pair of grooves 2311 at a rear, lower surface thereof. The third base part 241 has three grooves 2411 at a front face thereof and four rounded corners 2412 forming a peripheral ridge.

Figure 14:
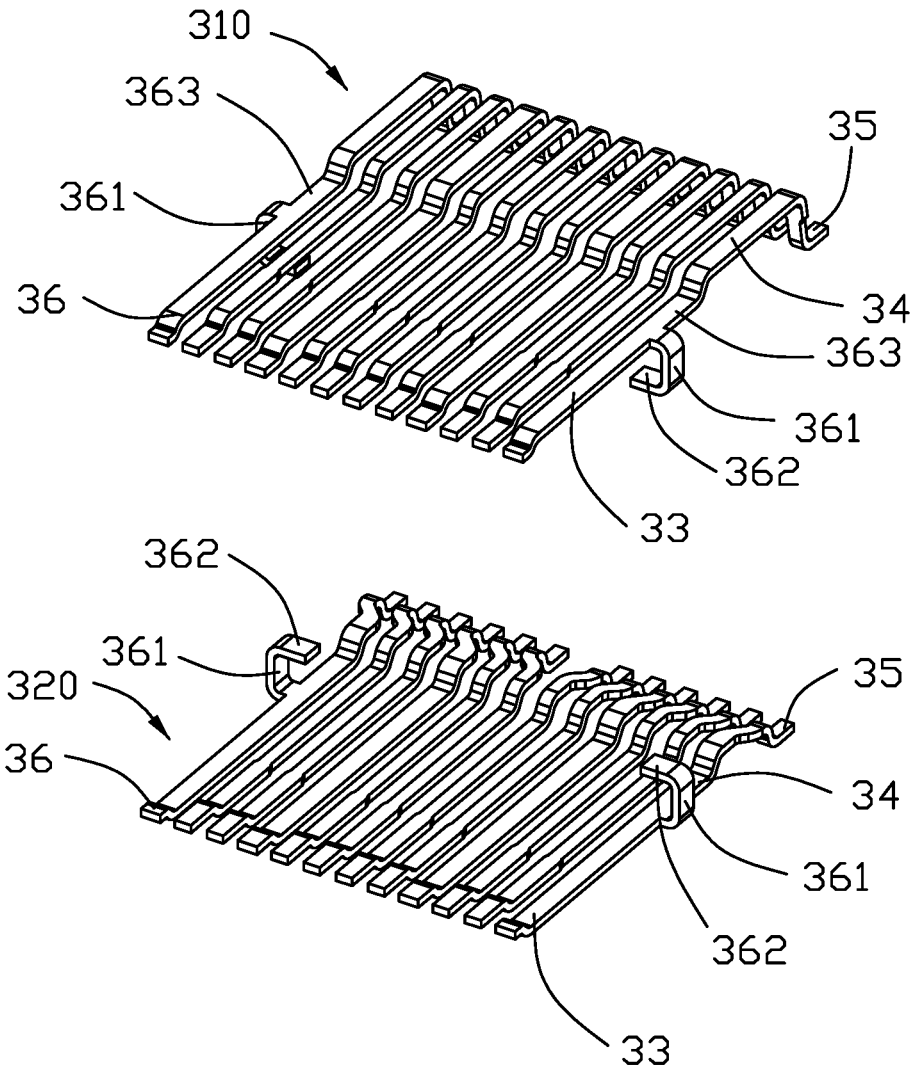
FIG. 14 gives a perspective view of an upper and lower rows of contacts of the contact module.
Figure 15:
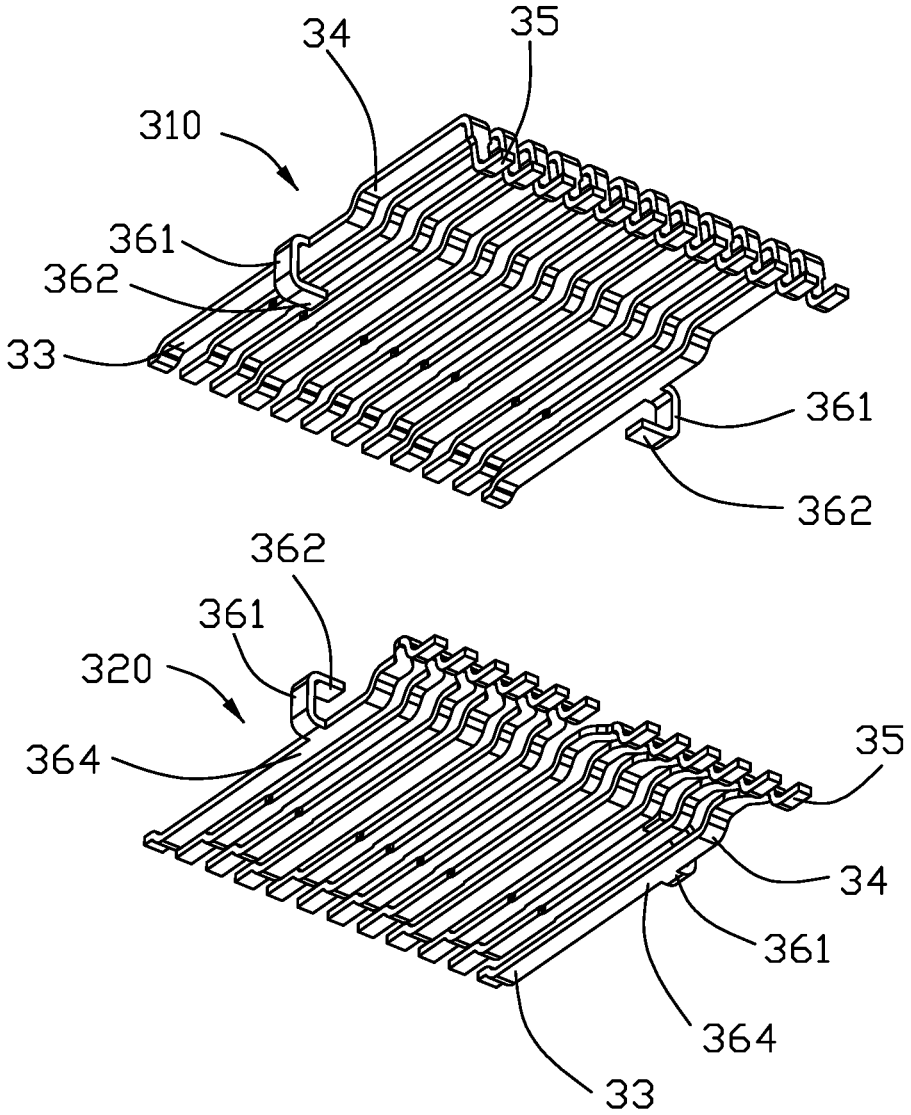
FIG. 15 is a view similar to FIG. 14 but from a different perspective.
Figure 16:
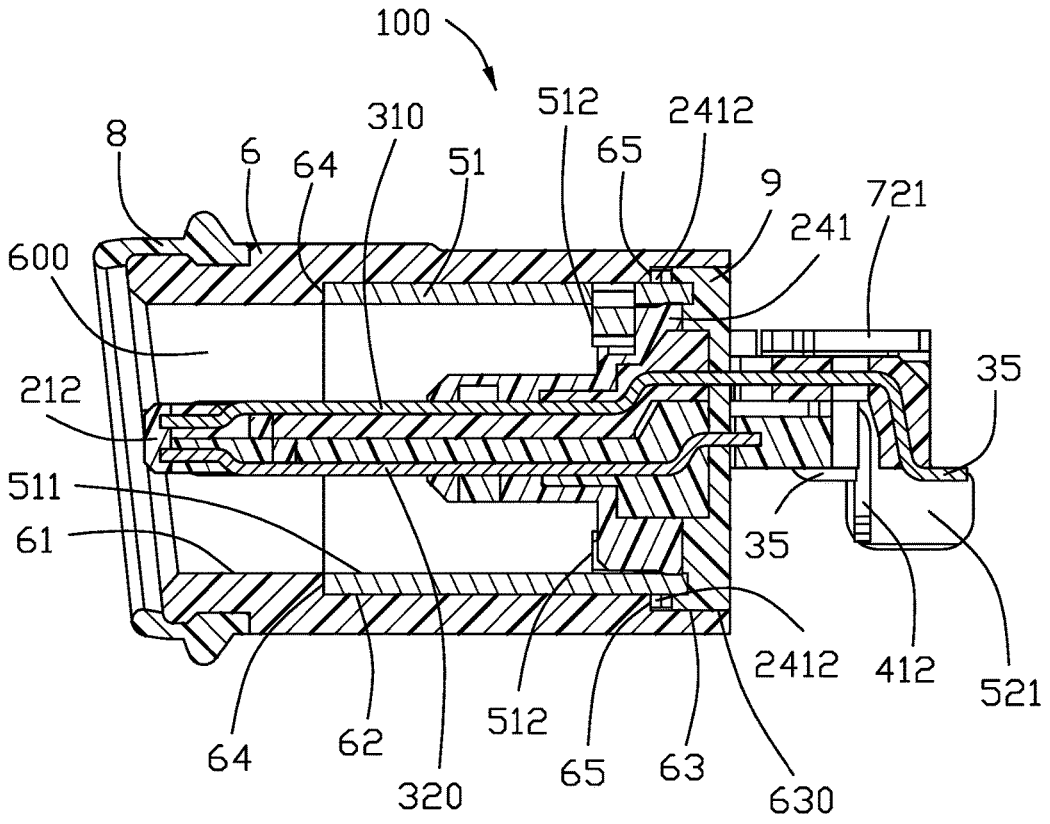
FIG. 16 is a cross-sectional view of the electrical connector taken along line A-A in FIG. 1.
Figure 17:
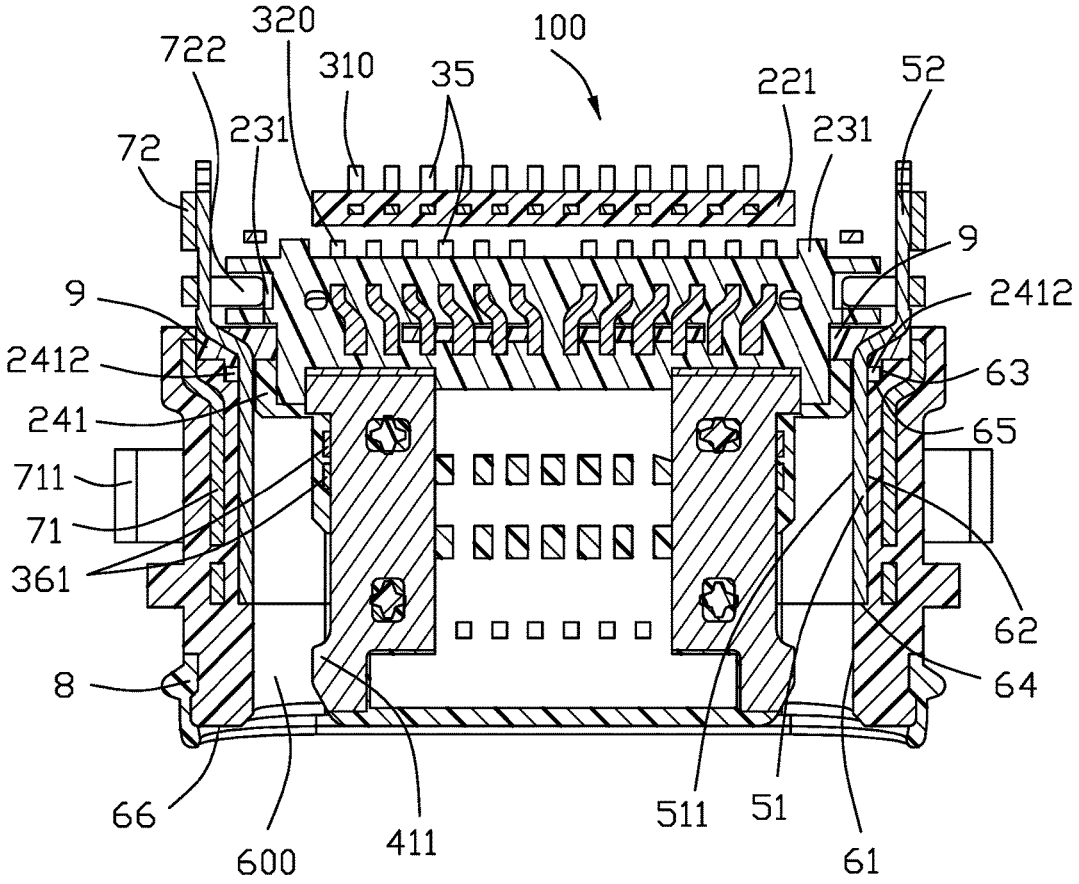
FIG. 17 is a cross-sectional view of the electrical connector taken along line B-B in FIG. 1

Also referring to FIGS. 14 and 15, each contact has a contacting portion 33 exposed to the tongue 212, a securing portion 34, and a tail 35. Each of the upper row of contacts and the lower row of contacts includes a pair of outermost grounding contacts 36. Each grounding contact 36 has an engaging section 361 at one lateral side of a corresponding securing portion. The engaging section 361 is in the form of a hook and has an end 362.

Referring specifically to FIGS. 10-13 and 17, the metal sheet 4 is constructed as a pair of plates 41. Each plate 41 has a main part 411 having a side notch of latching, and a soldering leg 412 for mounting to the printed circuit board.

Referring specifically to FIGS. 4-5, 8-9, and 16-17, the shielding shell 5 is metallic and includes a main part 51 and a pair of side arms 52 at rear sides of the main part. The main part 51 has plural front stoppers 512 and rear stoppers 513. Each side arm 52 has a soldering leg 521.

Referring specifically to FIGS. 1-7 and 16-17, the outer cover 6 has a first interior wall 61, a second interior wall 62, and a third interior wall 63. A front interior step 64 is formed between the first and second interior walls 61 and 62 and a rear interior step 65 is formed between the second and third interior walls 62 and 63.

Referring specifically to FIGS. 4-7, each of the pair of brackets 7 has an embedded portion 71, a rear fixing arm 72 extending out of the outer cover 6, and a supporting arm 711. The fixing arm 72 has an upper latching portion 721 and a lower holding portion 722. The latching portion 721 has an opening 7211 receiving the protrusion 2211 of the housing base 211. The holding portion 722 is received in the groove 2311. The fixing arm 72 further has a positioning portion 7212. The upper latching portions 721 and the lower holding portions 722 together firmly wrap around the base 211 of the insulative housing 210.

In assembling the connector 100, as is generally known in this art, firstly the upper and lower contact units 22 and 23 are respectively molded and then the metal sheet 4 and the two units 22 and 23 are mounted together and further molded with the body 24 to form the contact module 200. During mounting, the engaging sections 361 of the grounding contacts 36 make contact with the metal sheet 4 to achieve a better grounding effect and the ends 362 of upper and lower grounding contacts are mutually hook to (further welded if desired) lower and upper contact faces 364 and 363 to create a firm structure.

In mounting the shielding shell 5 to the contact module 200, an interior wall 511 of the main part 51 engages the third base part 241 and the stoppers 512 abut the grooves 2411. The stoppers 512 extends slight out of the grooves 2411 so that a mating connector, in the case of over insertion, will touch the front stoppers 512 instead of the contact module for protection purpose. Subsequently, the rear stoppers 513 are bent to engage a rear of the contact module so that the front and rear stoppers 51 and 513 together firmly engage the contact module 200. The four corners 2412 extend beyond an exterior surface of the main part 51.

In assembling the outer cover 6 insert-molded with the brackets 7 to the already mounted together contact module 200 and shielding shell 5, the main part 51 is mounted to the second interior wall 62 with a front end thereof abutting the front interior step 64. Also, the peripheral ridge formed by the corners 2412 abut the rear interior step 65, the interior wall 511 of the shielding shell 5 is flush with the first interior wall 61, and a mating space 600 is formed. The upper latching portions 721 and the lower holding portions 722 of the brackets 7 are bent to engage the insulative housing 210 which prevents the soldering legs 521 of the shielding shell 5 from displacement or moving outwardly.

The rear sealing member 9 may be applied at this time to a rear area 630 between the third interior wall 63 and the base 211 as well as a rear of the outer cover 6. The four corners 2412 are effective in blocking molten materials from entering the space 600 through the interior step 65.

By further welding the fixing arm 72 of the bracket 7 to the side arm 52 of the shielding shell 5, an even firmer structure may be obtained.

What is claimed is:

1. An electrical connector comprising:

a contact module including an insulative housing and an upper and lower rows of contacts, the insulative housing having a base and a tongue;

a shielding shell enclosing the contact module and having a pair of soldering legs;

an insulative outer cover enclosing the shielding shell; and a pair of brackets insert-molded with the outer cover; wherein each of the pair of brackets is locked to the insulative housing to prevent a corresponding soldering leg from moving outwardly; wherein each bracket comprises a fixing arm having an opening, the base of the insulative housing comprises a pair of protrusions each received in a corresponding opening, and each of the pair of soldering legs is situated between an associated bracket and the insulative housing; wherein: the outer cover comprises a first interior wall, a second interior wall, front interior step between the first and second interior walls, and a rear interior step; an interior wall of the shielding shell is flush with the first interior wall; and the base of the insulative housing comprises a peripheral ridge abutting the rear interior step.

2. The electrical connector as claimed in claim 1, wherein each bracket is welded to an associated soldering leg.

3. The electrical connector as claimed in claim 1, wherein each bracket comprises an upper latching portion and a lower holding portion together wrapping around the base of the insulative housing.

4. The electrical connector as claimed in claim 1, wherein each bracket comprises a supporting arm extending outwardly and downwardly.

5. An electrical connector comprising:

a contact module including an insulative housing and an upper and lower rows of contacts embedded within the insulative housing, the insulative housing having a base and a tongue forwardly extending from the base along a front-to-back direction;

a metallic shielding shell enclosing the contact module and having a pair of soldering legs;

an insulative outer cover enclosing the shielding shell; and a pair of metallic brackets insert-molded with the insulative outer cover; wherein the insulative outer cover forms an inner step structure and the housing forms a corresponding ridge to compliantly abut against the step structure so as to prevent forward contamination of a sealing member which is applied upon a rear side of the contact module and disposed in the insulative outer cover; wherein each of the pair of brackets prevents the corresponding soldering leg of the shielding shell from moving in a transverse direction perpendicular to the front-to-back direction; wherein said contact module further including a pair of plates between the upper and lower of terminals in a vertical direction perpendicular to the front-to-back direction, and each of said plates includes a locking notch on a side and a soldering leg beside the corresponding soldering leg of the shielding shell.

6. The electrical connector as claimed in claim 5, wherein said ridge extends radially beyond the metallic shielding shell so as to abut against a corresponding rear edge of the metallic shielding shell.

7. The electrical connector as claimed in claim 5, wherein each of the pair of brackets is fastened to the housing and abuts against the corresponding soldering leg.

8. The electrical connector as claimed in claim 5, wherein each of the pair of brackets includes a supporting arm spaced from the corresponding soldering leg of the shielding shell and adapted to be positioned upon a printed circuit board.

9. An electrical connector comprising:

a contact module including an insulative housing and an upper and lower rows of contacts embedded within the insulative housing, the insulative housing having a base and a tongue forwardly extending from the base along a front-to-back direction;

a metallic shielding shell enclosing the contact module and having a pair of soldering legs;

an insulative outer cover enclosing the shielding shell; and a pair of metallic brackets insert-molded with the insulative outer cover; wherein the contact module rearwardly extends beyond a rear end of the insulative outer cover where a sealing member is applied to cover a rearward face of the contact module; wherein the housing forms a ridge forwardly abutting against a corresponding step structure on an inner surface of the insulative outer cover for preventing contamination of the sealing member; wherein said ridge forwardly abuts against a rear edge of the shielding shell.

10. The electrical connector as claimed in claim 9, wherein said pair of brackets are engaged with the housing of the contact module.

11. The electrical connector as claimed in claim 10, wherein said pair of brackets restrain outward movement of the corresponding soldering legs in a transverse direction perpendicular to the front-to-back direction.

12. The electrical connector as claimed in claim 9, wherein said contact module further including a pair of plates between the upper and lower of terminals in a vertical direction perpendicular to the front-to-back direction, and each of said plates includes a locking notch on a side and a soldering leg beside the corresponding soldering leg of the shielding shell.

13. The electrical connector as claimed in claim 9, wherein each of the pair of brackets includes a supporting arm spaced from the corresponding soldering leg of the shielding shell and adapted to be positioned upon a printed circuit board.

* * * * *